US010969068B1

(12) United States Patent
Liao et al.

(10) Patent No.: US 10,969,068 B1
(45) Date of Patent: Apr. 6, 2021

(54) LED BOX APPARATUS

(71) Applicant: XIAMEN LEEDARSON LIGHTING CO. LTD, Fujian (CN)

(72) Inventors: Qingyue Liao, Fujian (CN); Liangliang Cao, Fujian (CN)

(73) Assignee: XIAMEN LEEDARSON LIGHTING CO. LTD, Xiamen (CN)

( * ) Notice: Subject to any disclaimer, the term of this patent is extended or adjusted under 35 U.S.C. 154(b) by 0 days.

(21) Appl. No.: 16/916,118

(22) Filed: Jun. 30, 2020

(51) Int. Cl.

| | |
|---|---|
| ***F21S 4/28*** | (2016.01) |
| ***F21V 17/10*** | (2006.01) |
| ***F21V 23/00*** | (2015.01) |
| ***F21V 23/04*** | (2006.01) |
| ***F21V 23/06*** | (2006.01) |
| ***F21V 14/02*** | (2006.01) |
| ***F21S 9/02*** | (2006.01) |
| ***F21V 33/00*** | (2006.01) |
| ***F21Y 115/10*** | (2016.01) |

(52) U.S. Cl.
CPC . *F21S 4/28* (2016.01); *F21S 9/02* (2013.01); *F21V 14/02* (2013.01); *F21V 17/107* (2013.01); *F21V 23/003* (2013.01); *F21V 23/0435* (2013.01); *F21V 23/0464* (2013.01); *F21V 23/06* (2013.01); *F21V 33/0052* (2013.01); *F21Y 2115/10* (2016.08)

(58) Field of Classification Search
CPC .... F21S 4/28; F21S 9/02; F21V 14/02; F21V 17/107; F21V 23/003; F21V 23/0435; F21V 23/0464; F21V 23/06
USPC ..... 362/225
See application file for complete search history.

(56) References Cited

U.S. PATENT DOCUMENTS

| | | | | |
|---|---|---|---|---|
| 5,716,123 | A * | 2/1998 | Lamming | F21V 3/04 362/222 |
| 6,517,216 | B1 * | 2/2003 | Cercone | F21S 8/026 362/220 |
| 2002/0060526 | A1 * | 5/2002 | Timmermans | F21K 9/275 315/246 |
| 2002/0114156 | A1 * | 8/2002 | Wendel | F21V 19/008 362/221 |
| 2010/0302770 | A1 * | 12/2010 | Lee | F21V 29/89 362/218 |
| 2011/0267805 | A1 * | 11/2011 | Hua | F21V 29/74 362/101 |
| 2012/0106157 | A1 * | 5/2012 | Simon | F21V 25/04 362/249.05 |

* cited by examiner

*Primary Examiner* — Bryon T Gyllstrom
(74) *Attorney, Agent, or Firm* — Chun-Ming Shih; Lanway IPR Services

(57) ABSTRACT

A light box includes a LED light tube including a first cap, a second cap, a first light body and a second light body. The first light body has a first main light emitting direction and the second light body has a second main light emitting direction. The first cap and the second cap each have two pins. The first cap and the second cap is fixed at two ends of the first light body providing a power to the first light body and the second light body. The angle between first main light emitting direction and the second main light emitting direction is adjustable by adjusting a relative position between the first light body and the second light body.

20 Claims, 12 Drawing Sheets

LED BOX APPARATUS

FIELD

The present invention is related to a box and more particularly related to a LED light.

BACKGROUND

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

LEDs were often used as indicator lamps in early days, replacing small incandescent bulbs, and in seven-segment displays. Recent developments have produced white-light LEDs suitable for room lighting. LEDs have led to new displays and sensors, while their high switching rates are useful in advanced communications technology.

Although lighting devices are widely used, there are still lots of opportunity and benefit to improve the lighting devices to provide more convenient, low cost, reliable and beautiful lighting devices for enhancing human life.

SUMMARY

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

A light box apparatus includes a LED light tube. The LED light tube includes a first cap, a second cap, a first light body and a second light body. The first light body has a first main light emitting direction and the second light body has a second main light emitting direction. The first cap and the second cap each having two pins. The first cap and the second cap is fixed at two opposite ends of the first light body providing a driving power to both the first light body and the second light body. The relative angle between first main light emitting direction and the second main light emitting direction is adjustable by adjusting a relative position between the first light body and the second light body. A bracket comprising multiple pin sockets, the pins of the first cap and the second cap being inserted into the pin sockets. A first light passing frame printed with visual information enlightened by a light emitted from the first light body.

In some embodiments, the first light body and the second light body are connected by a rotatable hinge. The second light body is rotated along the rotatable hinge to change the second main light emitting direction relative to the first main light emitting direction. In some embodiments, in a first mode, the first main light emitting direction and the second main light emitting direction face to the first light passing frame. The rotatable hinge changes the first main light emitting direction of the first light body and the second light emitting direction of the second light body to face the same direction, the illumination gathered on one side provides a larger light emitting area. The rotatable hinge changes the first main light emitting direction of the first body and the second light emitting direction of the second light body to face the opposite direction, the illumination divided into two direction provides two light emitting areas.

In some embodiments, the light box apparatus also includes a second light passing frame printed with another visual information. In a second mode, the first main light emitting direction faces to the first light passing frame, and the second main light emitting direction faces to the second light passing frame. The first main light emitting direction is opposite to the second light emitting direction.

In some embodiments, the light box apparatus also includes an angle fixing structure to fix a relative angle between the first light tube and the second light tube. The angle fixing structure may be attachable device with a first portion and a second portion. The first portion may be turned and replaced based on the installed direction of the light tube. The second portion is a connection the first portion as a maintained structure.

In some embodiments, the light box apparatus also includes a controller, and there are a plurality of the LED light tubes. A first set of the LED light tubes are turned on in a normal mode, and if one light tube of the first set of the LED light tubes is out of order, the controller turns on one light tube of a second set of the LED light tubes. The controller may sense when the LED light tubes of the first set needed the LED light tubes of the second set as a backup light in order to maintenance the illumination of the light box apparatus without changing the error light immediately. The second set of the LED light tubes may be stored in the light box apparatus against the first set of the LED light tubes. The controller may also sense the time of turning on the light of the light box apparatus and change the brightness of the illumination.

In some embodiments, the first cap has an extended electrode for connecting an attached device. The attached device sends a command to a driver of the LED light tube to control light emitting of the first light body and the second light body.

In some embodiments, the attached device has a wireless module for receiving a command from an external device to control the light emitting of the first light body and the second light body. In some embodiments, the first light body and the second light body are also controllable by a wire switch.

In some embodiments, the attached device is a light sensor attached to the light passing frame to detect an external light level and the LED light tube adjusts an emitted light according to the external light level.

In some embodiments, the attached device is a speaker. The speaker may be connected to a microphone, a cellphone or a broadcast device to transmit a voice of a user and a voice of a recorder to the speaker of the light box. The voice is broadcast wider throughout the height and the position of the light box. In some embodiments, the attached device collects a status of the LED light tube and wireless transmits the status to an external device.

In some embodiments, the attached device is a battery for providing battery power to the LED light tube. The attached device provides the light electricity to keep the illumination of the light tubes even when the electricity is cut off.

In some embodiments, the light box apparatus also includes a forward electrode, the forward electrode routing a second power to another light apparatus. In some embodiments, the driver controls the another light apparatus in addition to provide the second power to the another light apparatus. A first light apparatus may receive the power from the power socket and transmit the power to the second light apparatus. The first light apparatus may also have the driver to provide a second power to other light apparatus. After providing the second power, the first light apparatus may be turned off, but the other light apparatus is turned on. When a distance between the light apparatus is long, this may be a way to light up the light without find the switch on the wall by giving a command to a light apparatus to provide the power to the other light apparatus.

In some embodiments, the first light tube has multiple LED module, main light emitting directions of the multiple LED modules are arranged to emit to a hemisphere. The hemisphere provides an illuminance area with lighting angles for a whole direction illumination.

In some embodiments, the multiple LED modules are divided into multiple sections. The multiple sections are controlled separately for adjusting relative luminance levels between the multiple sections. The multiple sections are controlled to provide a light box apparatus without a dark portion.

In some embodiments, the LED light tube further comprises a sensor for collecting an ambient luminance level of an adjacent LED light tube to adjust relative luminance levels between the multiple sections. The sensor may control the illumination of every LED light tube to be in the luminance level that provides the light box apparatus to irradiate the same from the outside without dark lines and dark spots.

In some embodiments, the LED light tube has a switch for changing a color temperature of the LED light tube. The color temperature of the LED light tube may be changes related to the colors and the image of the light box. The color temperature is determined to be more suitable for the image to pop out to be more attractive.

In some embodiments, the switch is mounted on the first cap and is manually operated by a user. The user may set up a mode of the period of the illumination and the color temperature of the light from the switch, and the light may be turned on automatically based on the time the user determined.

DETAILED DESCRIPTION

Figure 1:
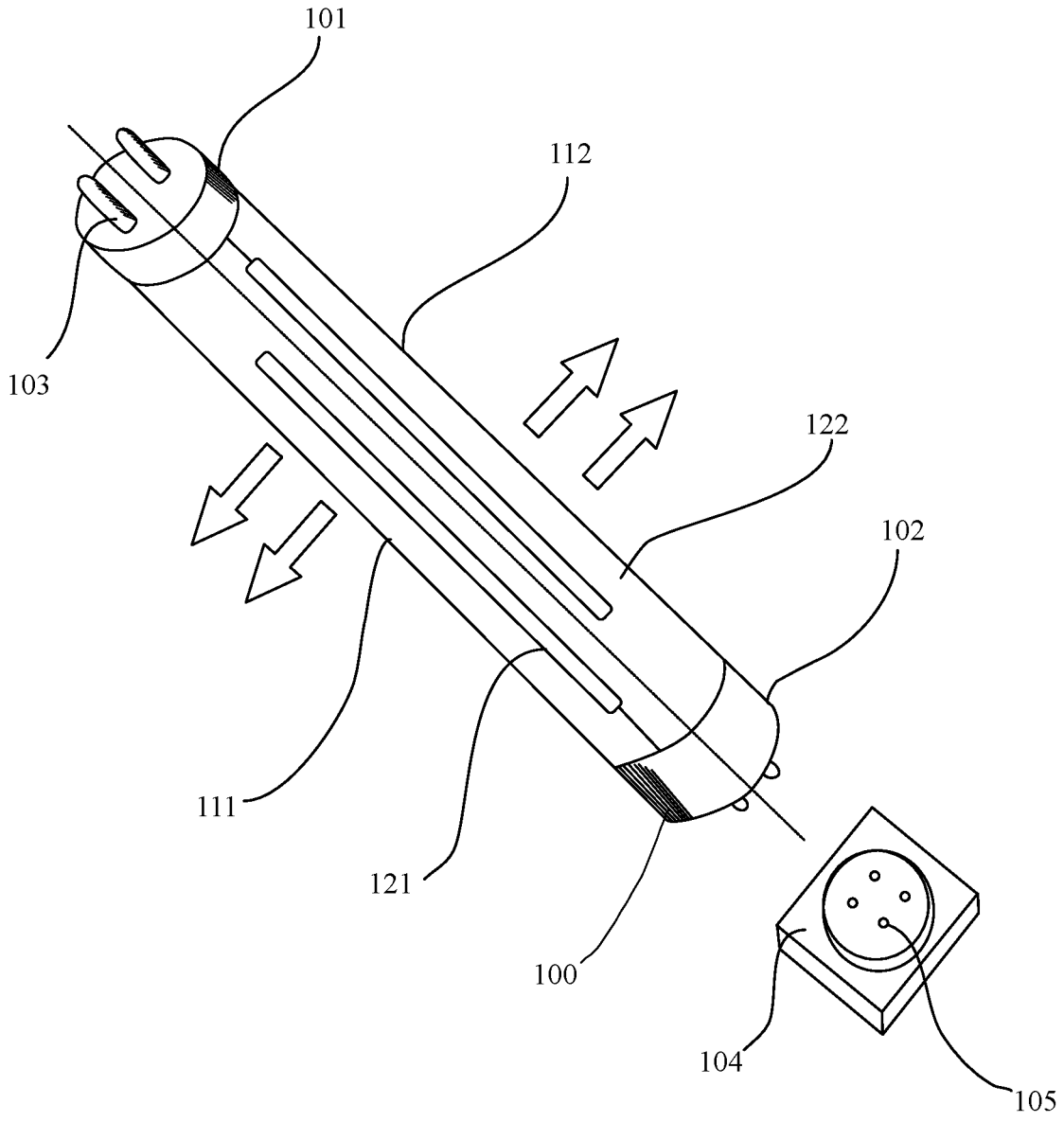
FIG. 1 is a schematic view of a LED light tube according to an embodiment of the present disclosure.
Figure 2:
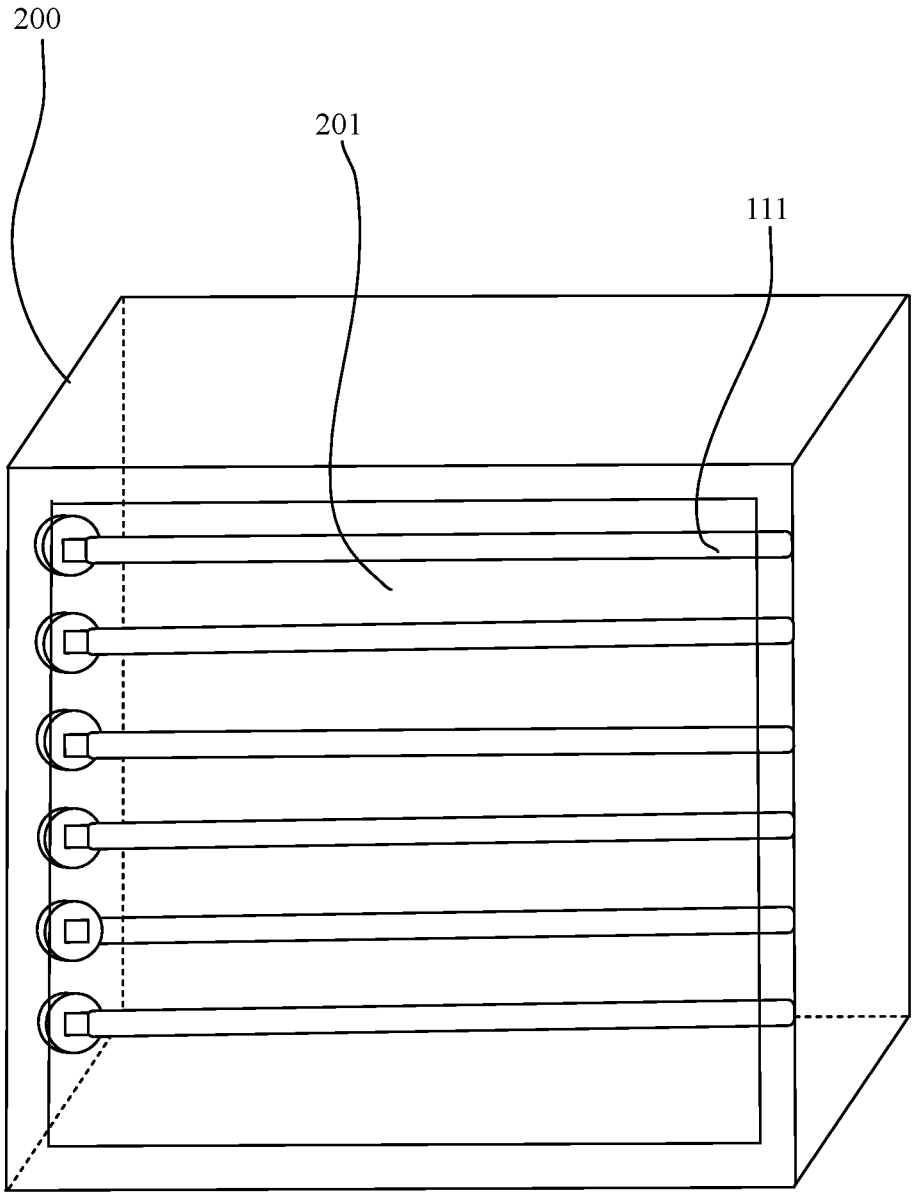
FIG. 2 is a perspective view of a light box apparatus according to an embodiment of the present disclosure.

Referring to FIG. 1 and FIG. 2, a light box apparatus 200 includes a LED light tube 100. The LED light tube 100 includes a first cap 101, a second cap 102, a first light body 111 and a second light body 112. The first light body 111 has a first main light emitting direction 121 and the second light body 112 has a second main light emitting direction 122. The first cap 101 and the second cap 102 each having two pins 103. The first cap 101 and the second cap 102 is fixed at two opposite ends of the first light body 111 providing a driving power to both the first light body 111 and the second light body 112. The relative angle between first main light emitting direction 121 and the second main light emitting direction 122 is adjustable by adjusting a relative position between the first light body 111 and the second light body 112. A bracket 104 comprising multiple pin sockets 105, the two pins 103 of the first cap 101 and the second cap 102 being inserted into the pin sockets 105. A first light passing frame 201 printed with visual information enlightened by a light emitted from the first light body 111.

Figure 3:
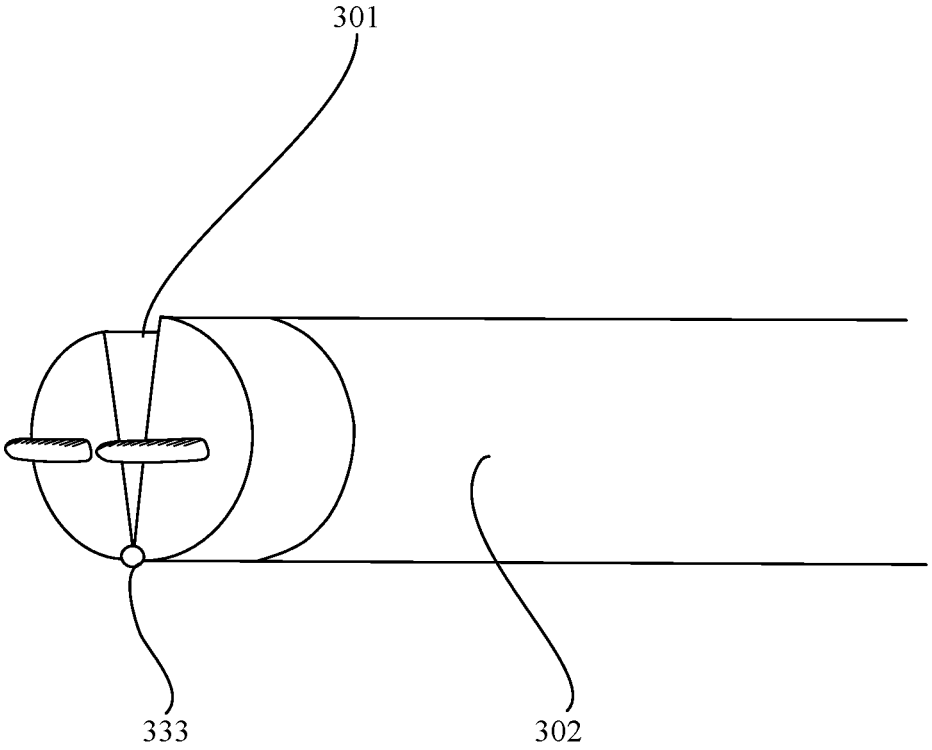
FIG. 3 is a schematic view of a LED light tube according to an embodiment of the present disclosure.

Referring to FIG. 3, the first light body 301 and the second light body 302 are connected by a rotatable hinge 333. The second light body 302 is rotated along the rotatable hinge 333 to change the second main light emitting direction relative to the first main light emitting direction.

Figure 4A:
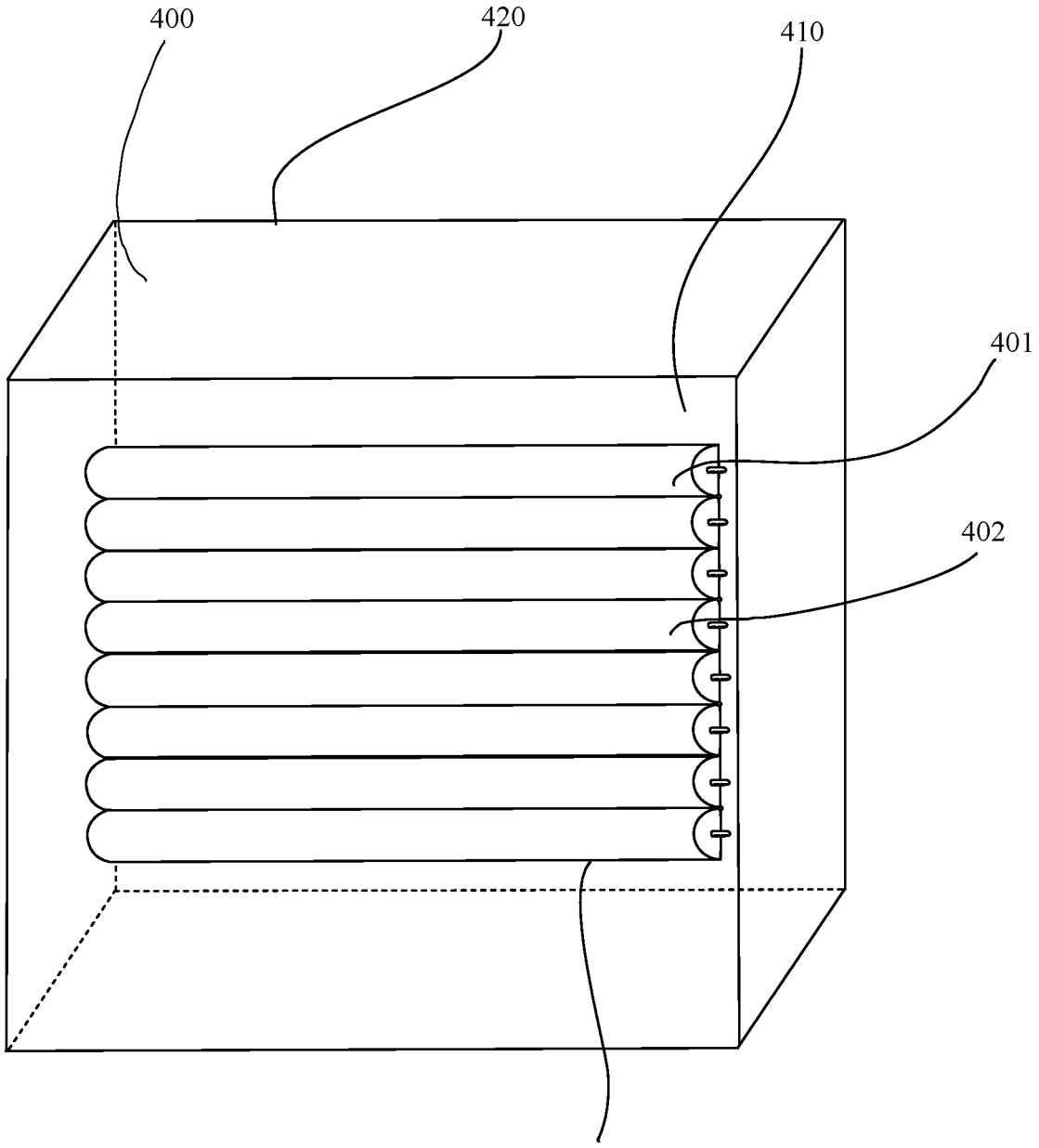
FIG. 4A is a perspective view of a light box apparatus according to an embodiment of the present disclosure.
Figure 4B:
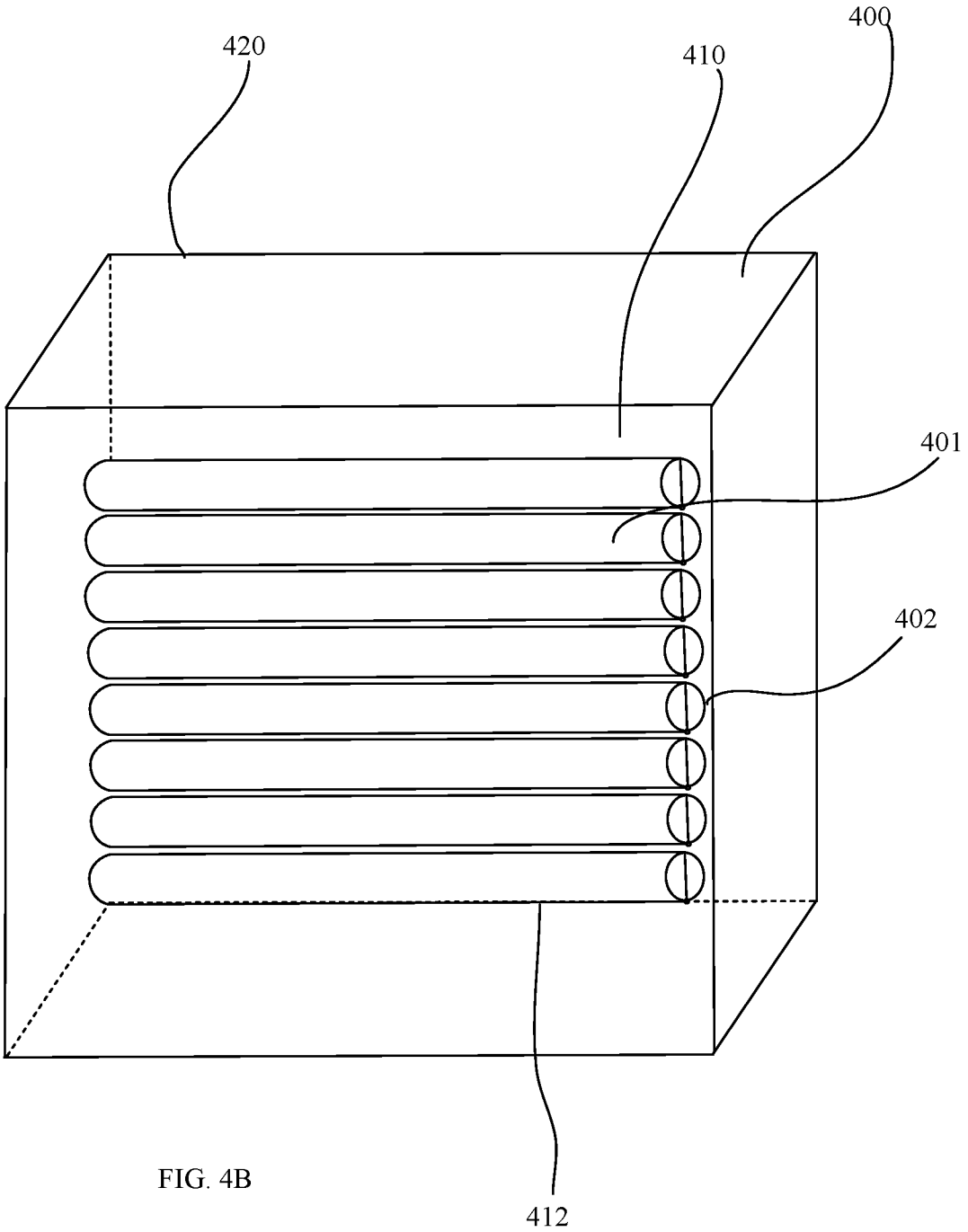
FIG. 4B is a perspective view of a light box apparatus according to an embodiment of the present disclosure.

Referring to FIG. 3, FIG. 4A and FIG. 4B, in a first mode 411, the first main light emitting direction 401 and the second main light emitting direction 402 face to the first light passing frame 410. The rotatable hinge 333 changes the first main light emitting direction 401 of the first light body and the second light emitting direction 402 of the second light body to face the same direction, the illumination gathered on one side provides a larger light emitting area. The rotatable hinge 333 changes the first main light emitting direction 401 of the first body and the second light emitting direction 402 of the second light body to face the opposite direction, the illumination divided into two direction provides two light emitting areas.

In some embodiments, the light box apparatus 400 also includes a second light passing frame 420 printed with another visual information. In a second mode 412, the first main light emitting direction 401 faces to the first light passing frame 410, and the second main light emitting direction 402 faces to the second light passing frame 420.

The first main light emitting direction 401 is opposite to the second light emitting direction 402.

Figure 5:
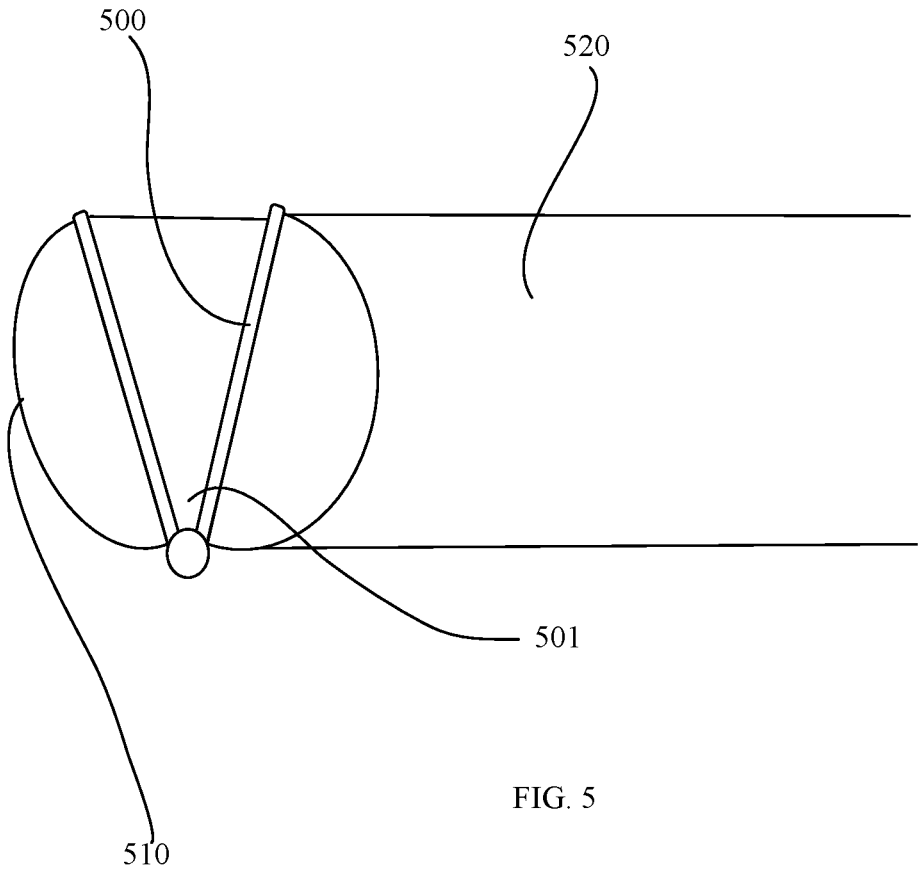
FIG. 5 is a schematic view of a LED light tube according to an embodiment of the present disclosure.

Referring to FIG. 5, the light box apparatus also includes an angle fixing structure 500 to fix a relative angle 501 between the first light body 510 and the second light body 520. The angle fixing structure 500 may be attachable device with a first portion and a second portion. The first portion may be turned and replaced based on the installed direction of the light tube. The second portion is a connection to the first portion as a maintained structure.

Figure 6A:
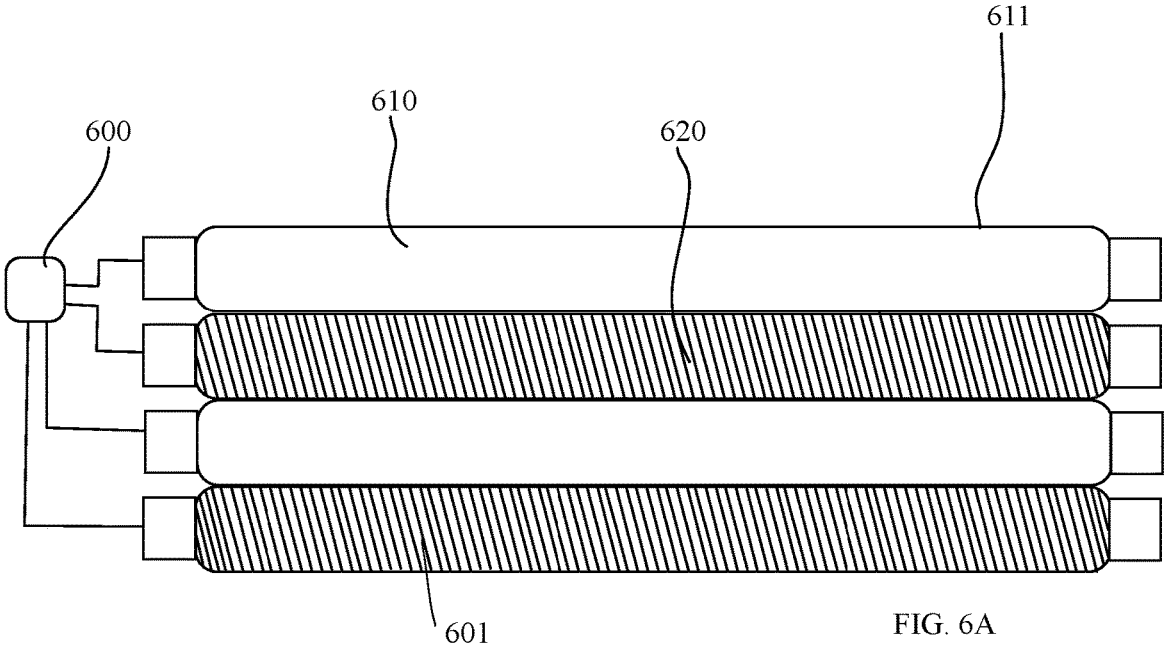
FIG. 6A is a schematic view of a LED light tube according to an embodiment of the present disclosure.
Figure 6B:
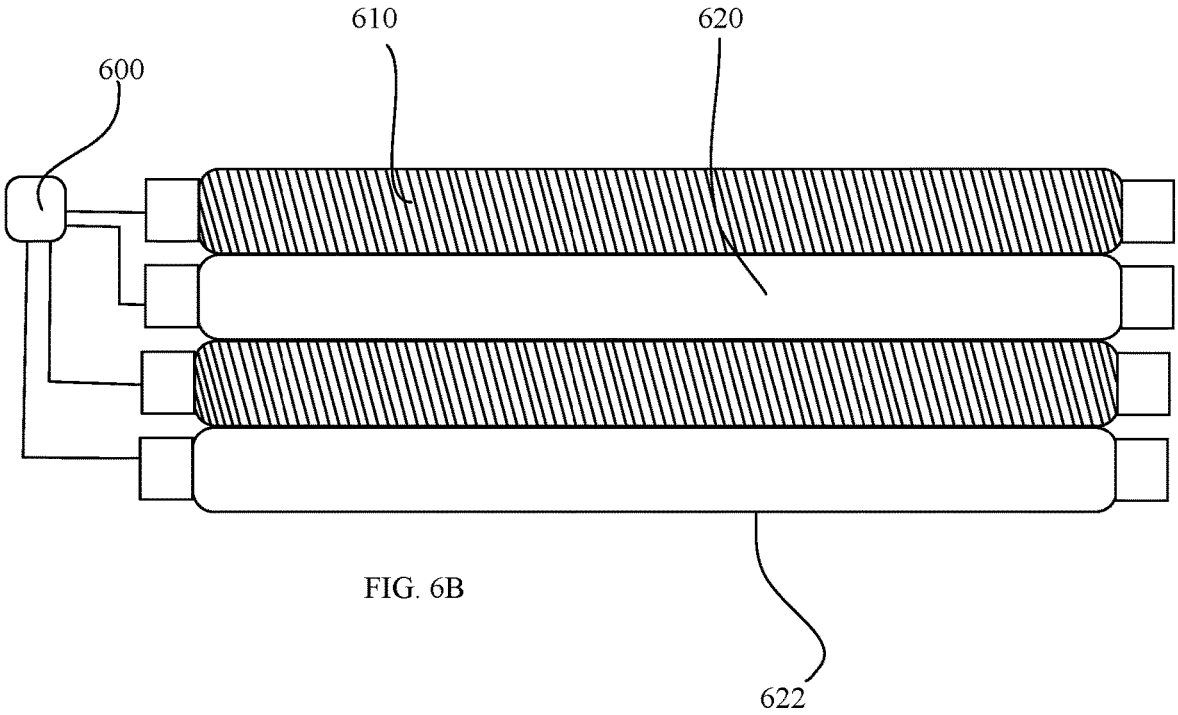
FIG. 6B is a schematic view of a LED light tube according to an embodiment of the present disclosure.

Referring to FIGS. 6A and 6B, the light box apparatus also includes a controller 600, and there are a plurality of the LED light tubes 601. A first set 610 of the LED light tubes 601 are turned on in a normal mode 611, and if one light tube of the first set 610 of the LED light tubes 601 is out of order, the controller 600 turns on one light tube of a second set 620 of the LED light tubes 601. The controller 600 may sense when the LED light tubes 601 of the first set 610 needed the LED light tubes 601 of the second set 620 as a backup light in order to maintenance the illumination of the light box apparatus without changing the error light immediately. The second set of the LED light tubes may be stored in the light box apparatus against the first set of the LED light tubes. The controller may also sense the time of turning on the light of the light box apparatus and change the brightness of the illumination.

Figure 7:
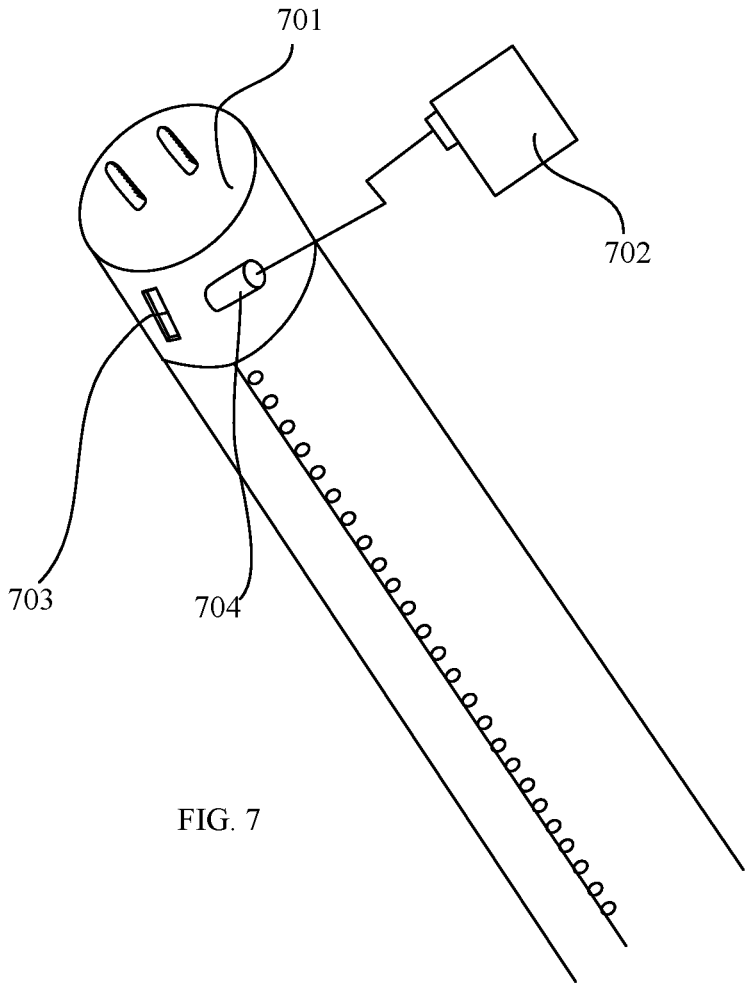
FIG. 7 is a perspective partial view of a LED light tube according to an embodiment of the present disclosure.

Referring to FIG. 7, the first cap 701 has an extended electrode 703 for connecting an attached device 702. The attached device 702 sends a command to a driver 704 of the LED light tube to control light emitting of the first light body and the second light body.

Figure 8:
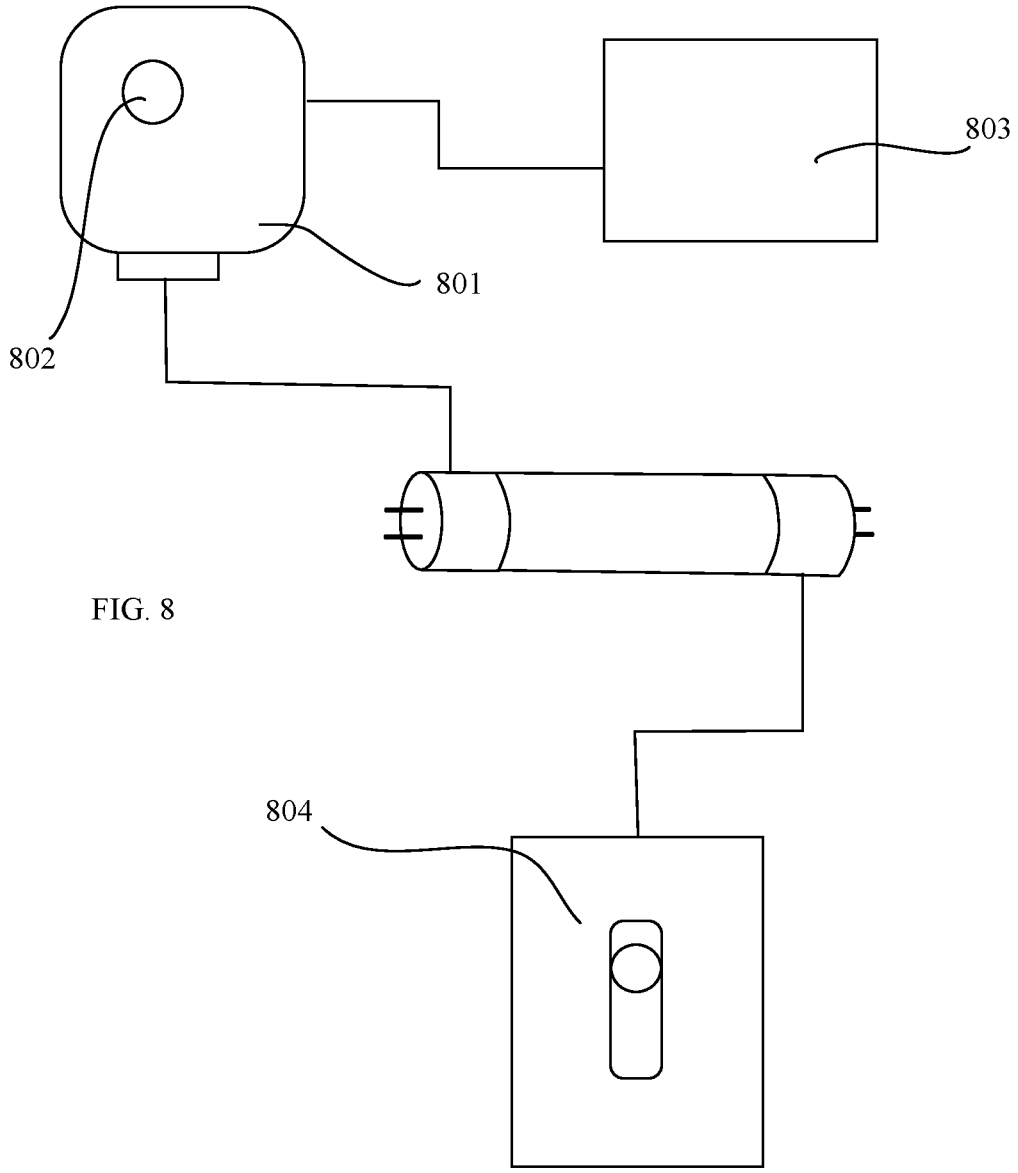
FIG. 8 is a schematic partial view of a light box apparatus according to an embodiment of the present disclosure.

Referring to FIG. 8, the attached device 801 has a wireless module 802 for receiving a command from an external device 803 to control the light emitting of the first light body and the second light body. In some embodiments, the first light body and the second light body are also controllable by a wire switch 804.

Figure 9A:
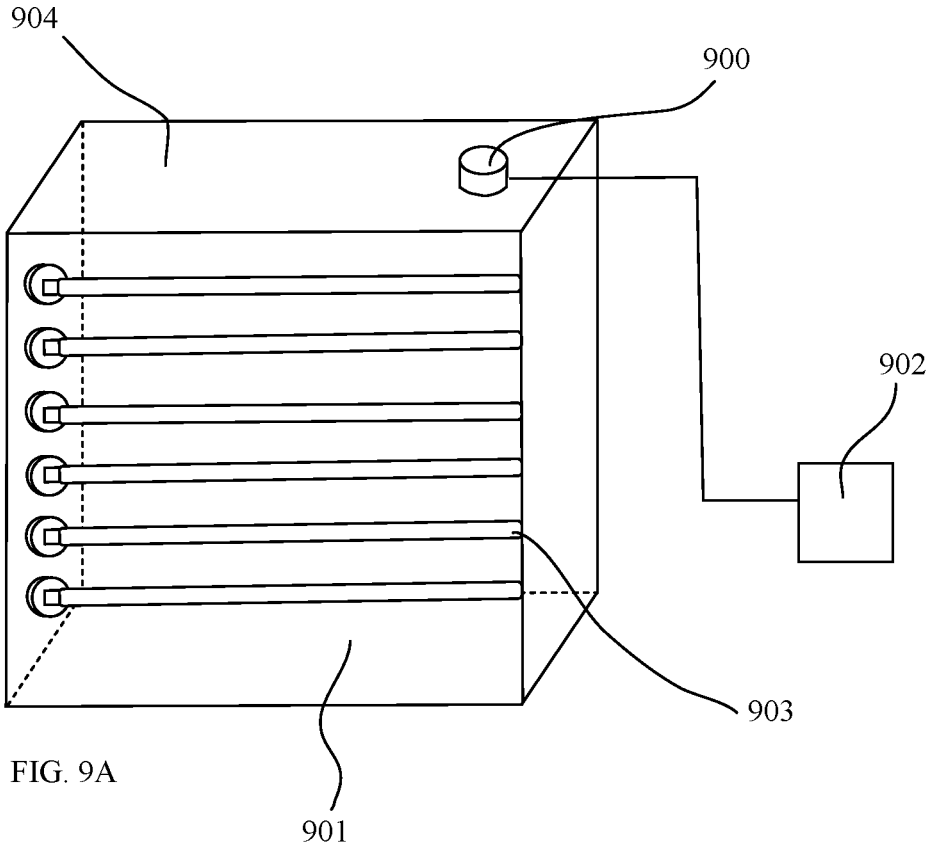
FIG. 9A is a perspective view of a light box apparatus according to an embodiment of the present disclosure.

Referring to FIG. 9A, the attached device is a light sensor 900 attached to the light passing frame 901 to detect an external light level 902 and the LED light tube 903 adjusts an emitted light according to the external light level 902.

Figure 9B:
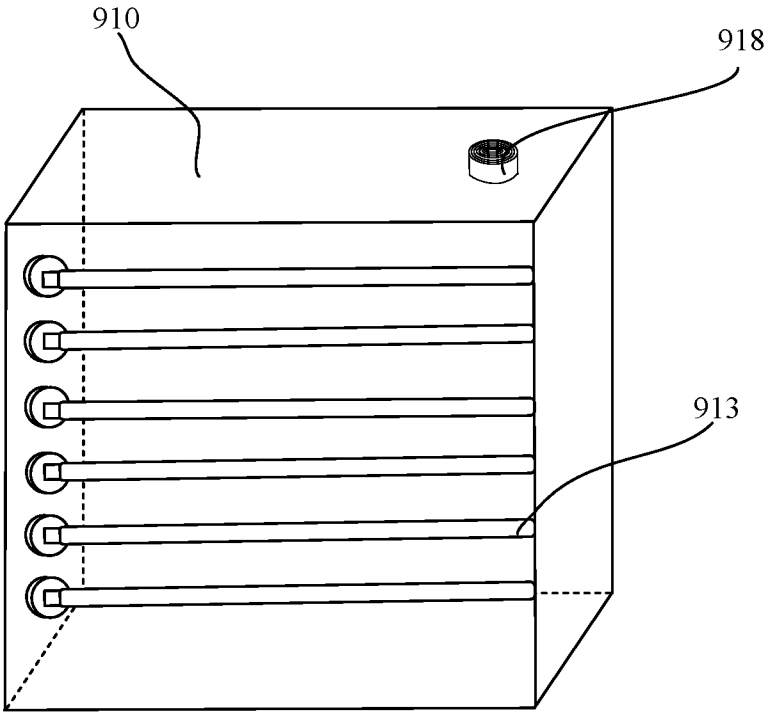
FIG. 9B is a perspective view of a light box apparatus according to an embodiment of the present disclosure.

Referring to FIG. 9B, the attached device is a speaker 918. The speaker 918 may be connected to a microphone, a cellphone or a broadcast device to transmit a voice of a user and a voice of a recorder to the speaker of the light box apparatus 910. The voice is broadcast wider throughout the height and the position of the light box apparatus 910.

Figure 9C:
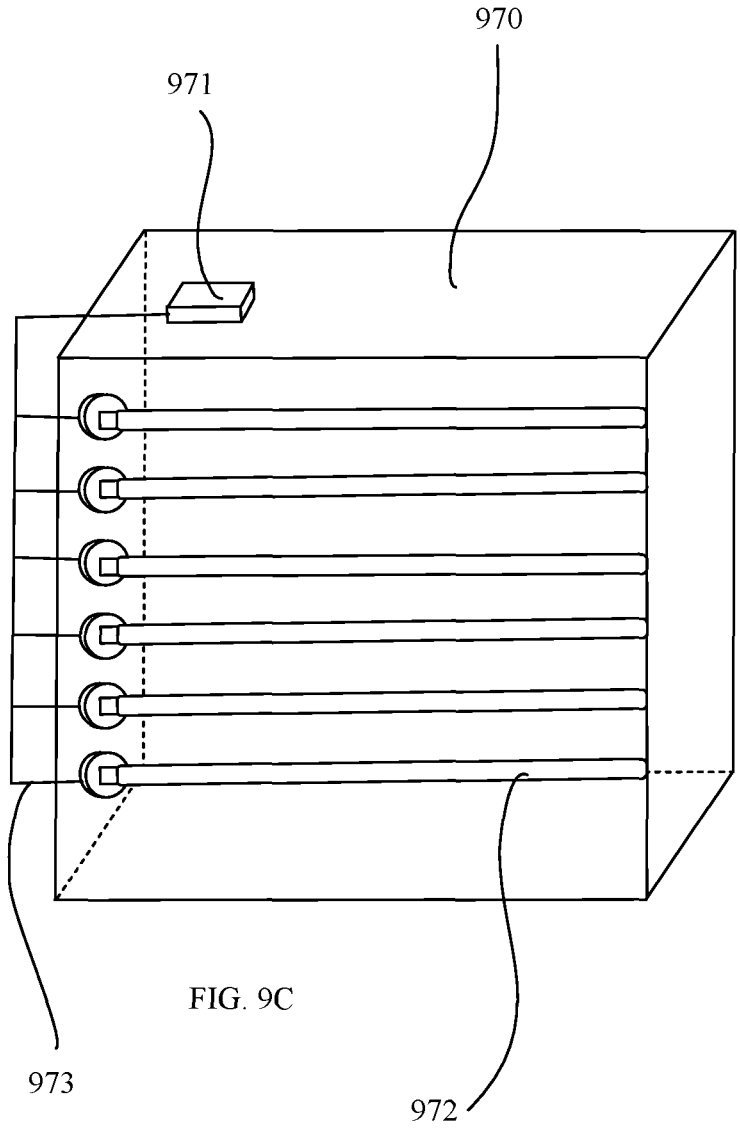
FIG. 9C is a perspective view of a light box apparatus according to an embodiment of the present disclosure.

In FIG. 9C, a light box 970 has multiple LED tubes 972. The multiple LED tubes 972 are connected in parallel with a wire bus 973 with power supply from a driver box 971. The driver box 971 may include control circuits for receiving both manual and wireless commands. Users may use a mobile phone installed with an associated app to configure the behavior of the multiple LED tubes 972.

Please refer to FIG. 8. In some embodiments, the attached device 801 collects a status of the LED light tube and wireless transmits the status to an external device 803.

In some embodiments, the attached device is a battery 971 for providing battery power to the LED light tube 972. The attached device provides the light electricity to keep the illumination of the light tubes even when the electricity is cut off.

Figure 10:
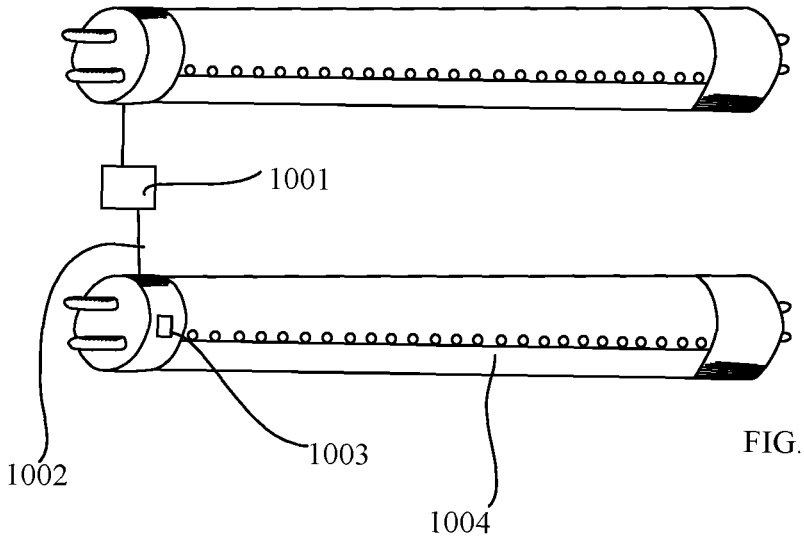
FIG. 10 is a perspective side view of a LED light tube and another LED light tube according to an embodiment of the present disclosure.

Please refer to FIG. 10, the light box apparatus also includes a forward electrode 1001, the forward electrode 1001 routing a second power 1002 to another light apparatus 1004. In some embodiments, the driver 1003 controls the another light apparatus 1004 in addition to provide the second power 1002 to the another light apparatus 1004. A first light apparatus may receive the power from the power socket and transmit the power to the second light apparatus. The first light apparatus may also have the driver to provide a second power to other light apparatus. After providing the second power, the first light apparatus may be turned off, but the other light apparatus is turned on. When a distance between the light apparatus is long, this may be a way to light up the light without find the switch on the wall by giving a command to a light apparatus to provide the power to the other light apparatus.

Figure 11:
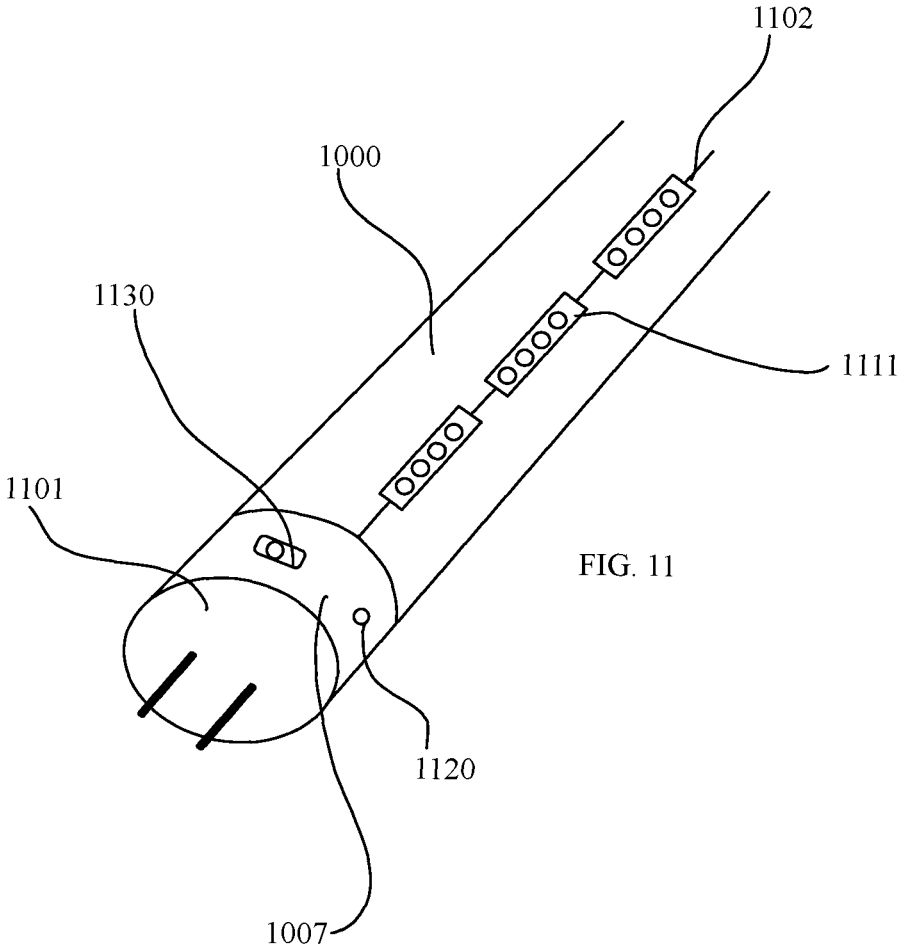
FIG. 11 is a perspective partial view of a LED light tube according to an embodiment of the present disclosure.

Please refer to FIG. 11, the LED light tube 1101 has multiple LED modules 1102, a main light emitting directions of the multiple LED modules 1102 are arranged to emit to a hemisphere 1000. The hemisphere 1000 provides an illuminance area with lighting angles for a whole direction illumination.

In some embodiments, the multiple LED modules 1102 are divided into multiple sections 1111. The multiple sections 1111 are controlled separately for adjusting relative luminance levels between the multiple sections 1111. The multiple sections 1111 are controlled to provide a light box apparatus without a dark portion.

In some embodiments, the LED light tube 1101 further comprises a sensor 1120 for collecting an ambient luminance level of an adjacent LED light tube 1101 to adjust relative luminance levels between the multiple sections 1111. The sensor 1120 may control the illumination of every LED light tube 1101 to be in the luminance level that provides the light box apparatus to irradiate the same from the outside without dark lines and dark spots.

In some embodiments, the LED light tube 1101 has a switch 1130 for changing a color temperature of the LED light tube 1101. The color temperature of the LED light tube 1101 may be changes related to the colors and the image of the light box. The color temperature is determined to be more suitable for the image to pop out to be more attractive.

In some embodiments, the switch 1130 is mounted on the first cap 1007 and is manually operated by a user. The user may set up a mode of the period of the illumination and the color temperature of the light from the switch 1130, and the light may be turned on automatically based on the time the user determined.

The foregoing descriptions of a specific embodiment of the present disclosure have been presented for purposes of illustration and description. They are not intended to be exhaustive or to limit the disclosure to the precise forms disclosed, and obviously many modifications and variations are possible in light of the above teaching. The embodiment was chosen and described in order to best explain the principles of the disclosure and its practical application, to thereby enable others skilled in the art to best utilize the disclosure and various embodiments with various modifications as are suited to the particular use contemplated.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light box apparatus, comprising:

a LED light tube, comprising a first cap, a second cap, a first light body and a second light body, the first light body has a first main light emitting direction and the second light body has a second main light emitting direction, the first cap and the second cap each having two pins, the first cap and the second cap being fixed at two opposite ends of the first light body providing a driving power to both the first light body and the second light body, the relative angle between first main light emitting direction and the second main light emitting direction is adjustable by adjusting a relative position between the first light body and the second light body;

a bracket comprising multiple pin sockets, the pins of the first cap and the second cap being inserted into the pin sockets; and a first light passing frame printed with a visual information enlightened by a light emitted from the first light body.

2. The light box apparatus of claim 1, wherein the first light body and the second light body are connected by a rotatable hinge, the second light body is rotated along the rotatable hinge to change the second main light emitting direction relative to the first main light emitting direction.

3. The light box apparatus of claim 2, wherein in a first mode, the first main light emitting direction and the second main light emitting direction face to the first light passing frame.

4. The light box apparatus of claim 3, further comprising a second light passing frame printed with another visual information, wherein in a second mode, the first main light emitting direction faces to the first light passing frame, and the second main light emitting direction faces to the second light passing frame, the first main light emitting direction is opposite to the second main light emitting direction.

5. The light box apparatus of claim 2, further comprising an angle fixing structure to fix a relative angle between the first light body and the second light body.

6. The light box apparatus of claim 1, further comprising a controller, and there are a plurality of the LED light tubes, wherein a first set of the LED light tubes are turned on in a normal mode, and one light tube of the first set of the LED light tubes is out of order, the controller turns on one light tube of a second set of the LED light tubes to an backup mode.

7. The light box apparatus of claim 1, wherein the first cap has an extended electrode for connecting an attached device, the attached device sends a command to a driver of the LED light tube to control light emitting of the first light body and the second light body.

8. The light box apparatus of claim 7, wherein the attached device has a wireless module for receiving a command from an external device to control the light emitting of the first light body and the second light body.

9. The light box apparatus of claim 8, wherein the first light body and the second light body are also controllable by a wire switch.

10. The light box apparatus of claim 7, wherein the attached device is a light sensor attached to the light passing frame to detect an external light level and the LED light tube adjusts an emitted light according to the external light level.

11. The light box apparatus of claim 7, wherein the attached device is a speaker.

12. The light box apparatus of claim 7, wherein the attached device collects a status of the LED light tube and wireless transmits the status to an external device.

13. The light box apparatus of claim 7, wherein the attached device is a battery for providing battery power to the LED light tube.

14. The light box apparatus of claim 1, further comprising a forward electrode, the forward electrode routing a second power to another light apparatus.

15. The light box apparatus of claim 14, wherein the driver controls the another light apparatus in addition to provide the second power to the another light apparatus.

16. The light box apparatus of claim 1, wherein the LED light tube has multiple LED modules, a main light emitting directions of the multiple LED modules are arranged to emit to a hemisphere.

17. The light box apparatus of claim 16, wherein the multiple LED modules are divided into multiple sections and the multiple sections are controlled separately for adjusting relative luminance levels between the multiple sections.

18. The light box apparatus of claim 17, wherein the LED light tube further comprises a sensor for collecting an ambient luminance level of an adjacent LED light tube to adjust relative luminance levels between the multiple sections.

19. The light box apparatus of claim 1, wherein the LED light tube has a switch for changing a color temperature of the LED light tube.

20. The light box apparatus of claim 19, wherein the switch is mounted on the first cap and is manually operated by a user.

* * * * *